US005296859A

United States Patent [19]

Naito et al.

[11] Patent Number: 5,296,859

[45] Date of Patent: Mar. 22, 1994

[54] BROADBAND WAVE ABSORPTION APPARATUS

[75] Inventors: Yoshiyuki Naito, 8-9-29, Tsukimino, Yamato-Shi, Kanagawa-Ken; Tetsuya Mizumoto, Yokohama; Michiharu Takahashi, 390-190, Takazu, Yachiyo-Shi, Chiba-Ken, all of Japan

[73] Assignees: Yoshiyuki Naito, Kanagawa; Michiharu Takahashi, Chiba, both of Japan

[21] Appl. No.: 890,632

[22] Filed: May 28, 1992

[30] Foreign Application Priority Data

May 31, 1991 [JP] Japan ..... 3-129509

[51] Int. Cl.[5] ..... H01Q 17/00

[52] U.S. Cl. ..... 342/1; 342/4

[58] Field of Search ..... 342/1, 2, 3, 4

[56] References Cited

U.S. PATENT DOCUMENTS

| | | | |
|---|---|---|---|
| 3,568,195 | 3/1971 | Wesch et al. | 342/1 |
| 3,680,107 | 7/1972 | Meinke et al. | 342/1 |
| 3,737,903 | 6/1973 | Suetake et al. | 342/1 |
| 3,754,255 | 8/1973 | Suetake et al. | 342/4 |
| 3,887,920 | 6/1975 | Wright et al. | 342/1 |
| 3,938,152 | 2/1976 | Grimes et al. | 342/1 |
| 4,012,738 | 3/1977 | Wright | 342/1 |
| 4,023,174 | 5/1977 | Wright | 342/4 |
| 4,030,892 | 6/1977 | Mendelsohn et al. | 428/226 |
| 4,728,554 | 3/1988 | Goldberg et al. | 428/113 |
| 4,972,191 | 11/1990 | Ishino et al. | 342/1 |
| 5,083,127 | 1/1992 | Frye et al. | 342/1 |
| 5,084,705 | 1/1992 | Frye et al. | 342/1 |
| 5,103,231 | 4/1992 | Niioka | 342/1 |
| 5,110,651 | 5/1992 | Massard et al. | 342/1 |
| 5,121,122 | 6/1992 | Frye | 342/1 |
| 5,169,713 | 12/1992 | Kumurdjian | 428/323 |
| 5,198,138 | 3/1993 | Yamamoto et al. | 252/62.54 |
| 5,230,763 | 7/1993 | Roth et al. | 156/254 |

*Primary Examiner*—John B. Sotomayor
*Attorney, Agent, or Firm*—Ladas & Parry

[57] ABSTRACT

The provision of of an electromagnetic wave absorbing apparatus having a broadband electromagnetic wave absorbing characteristic, and which can also be used for the improvement of existing electromagnetic wave absorbing apparatus. Successive layers of an sintered ferrite magnetic body (F), a dielectric body (D) having a low permittivity, and a magnetic body (RF) having a low magnetic permeability, are overlapped on a flat reflector plate, and the relationship between the magnetic permeability $\mu 1$ of the sintered ferrite magnetic body and the magnetic permeability of the magnetic body having a low magnetic permeability is $\mu 1 \geqq 25 \cdot \mu 2$.

2 Claims, 6 Drawing Sheets

BROADBAND WAVE ABSORPTION APPARATUS

BACKGROUND OF THE INVENTION

The present invention relates to an electromagnetic wave absorption apparatus of a multi-layer structure and which uses sintered ferrite magnetic bodies, and more particularly to an electromagnetic wave absorption apparatus with broadband characteristics. (Problem to be Solved by the Invention)

An absorber for preventing the reflection of TV waves from buildings and electromagnetic wave darkrooms for the measurement of irradiated electromagnetic waves from electrical apparatus require a favorable absorption of electromagnetic waves over a broad frequency bandwidth. With respect to this, electromagnetic wave absorption bodies which use sintered ferrite have a thickness of 5–8 mm and also has excellent absorption of electromagnetic waves from low frequencies of 30 MHz for example.

FIG. 6 shows the structure of a most fundamental type of ferrite electromagnetic wave absorption body and is configured so that there is an sintered ferrite magnetic body having a thickness d, with a metallic conductor plate behind it (Refer to Hans Wilhelm Helberg "Die Absorption electromagnetischer Wellen in einem grossen Frequenzbereich durch eine duenne homogene Sehicht mit Velusten" Zeitschrifit fuer angewandte Physik, XIII Band Heft 5-1961, p. 237-245; Suetake et al. "Magnetic-type resistance film absorption barriers" Electronic Communications Society Microwave Research Association, 1967.1; Japanese Patent Publication No. 26143-1968.) When the magnetic field reflector coefficient of the surfaces of the ferrite magnetic bodies F in these configurations is made s, then the power absorption coefficient of the electromagnetic wave absorption body is $1-|s|^2$. Accordingly, there is more favorable absorption for the smaller the value of $|s|$. In normal cases, $|s| \leqq 0.1$ as a guide, or more specifically, coefficient of absorption $\geqq 0.99$ is used.

FIG. 7 shows the absorption characteristics of the electromagnetic wave absorption body shown in FIG. 6, when the frequency f is on the horizontal axis, and the coefficient of reflectivity $|s|$ is on the vertical axis. In this case, when the lower of the two frequencies for which $|s|=0.1$ is f1 and the higher is fh, then the frequency band B for which $|s|=0.1$ is satisfied becomes $$B=fh-f1$$

This frequency band B has the following relationship with the materials that are used to realize the electromagnetic wave absorption body.

(a) When f1 is to become 30 MHz, the ferrite which is used is of the sintered type and is therefore of an NiZn or MnZn system. The value for fh becomes 300–400 MHz using such a system.

(b) When f1 is to become 90 MHz, the ferrite which is used is also of the sintered type in this case, fh becomes 350–520 MHz.

Of these, an absorber described (a) assumes an absorber of an electromagnetic wave darkroom and so fh=1000 MHz with respect to f1=30 MHz but it is not possible to satisfy this requirement. In addition, with (b), an absorber so that walls of a building can absorb television waves is assumed and f1=90 MHz and fh=800 MHz are assumed, but it is also not possible to satisfy this (Refer to Naito et al. "Ferrite absorbers with broader bands" Electronic Communications Society, Microwave Research Association Japan 1968.3; "Die breitbandige Absorption electromagnetischer Wellen durch duenne Ferritschichten" Zeitschrifit fuer angewandte Physik, XIX Band Heft 6-1965, p.509-514; Japanese Patent Laid Open Application No. 101605-1989) and so the ferrite F shown in FIG. 6 is divided into the two portions F1 and F2 shown in the FIG. 8, and having the respective thicknesses d1 and d2, with a metal reflector plate being attached to the one portion d1, and the other portion d2 being placed apart at the interval Po. This interval Po is filled with air.

According to this configuration, it is possible to satisfy requirements for fh=1000 MHz for f1=30 MHz, and fh=800 MHz for f1=90 MHz. The ferrite F1 and F2 either have the same characteristics, or they can be slightly different. Sintered ferrite having a magnetic permeability of approximately 500 is used when ferrite having the same characteristics is used, and sintered ferrite having a magnetic permeability of approximately 500 is used for F1, and sintered ferrite having a magnetic permeability of approximately 200 is used for F2 so that the overall characteristics are roughly the same as for when the same material is used (Refer to Naito et al. "Ferrite absorbers with broader bands" Electronic Communications Society, Microwave Research Association 1968.3.)

Improved absorbers have not been used for the following reasons. The first is that having both F1 and F2 as sintered ferrite increases the cost, since the number of sintered materials doubles when the required area is configured as in this method.

FIG. 9 shows a conventional example of an absorber having a broader band, where a dielectric body D is inserted between a metal conductor plate C and a ferrite body F. In this case, it is possible to obtain f1=30 MHz and fh=1000 MHz (Refer to Hans Wilhelm Helberg, "Die Absorption electromagnetischer Wellen in einem duenne Materialschieht in Kleinem Abstand vor einer Metallfaeche" Zeitschrifit fuer angewandte Physik, XVI Band Heft 4-1963, p.214-220; Japanese Patent Publication No. 4423-1975; U.S. Pat. No. 3,754,225, Aug. 21, 1973; Japanese Patent Laid Open Application No. 35797-1990; Hashimoto et al., "Practical Design of simple, compact electromagnetic wave darkrooms using ferrite' Shingakuron, Vol. J73-B No. 8, p.421-431 [1990-08]; and S. Abdulah Mirtaheri et al. Widening the Bandwidth of Ferrite Absorbing Wall by Adding a Dielectric Layer" 1991 Electronic Information Communications Society, Shunki Zenkoku Taikai B-290.).

A frequency of 1000 MHz is the current maximum frequency fh, but in the future, when the operating frequencies of electronic apparatus, such as the clock frequencies of personal computers become higher, the electromagnetic waves which are generated by and irradiated from such apparatus will have higher frequencies and fh will become higher than 1000 MHz. (Summary of the invention)

In the light of the problems described above, the present invention has as an object the provision of an electromagnetic wave absorbing apparatus having a broadband electromagnetic wave absorbing characteristic, and which can also be used for the improvement of existing electromagnetic wave absorbing apparatus.

SUMMARY OF THE INVENTION

In order to attain this objective, the present invention provides a broadband electromagnetic wave absorbing apparatus which has successive layers of a sintered ferrite magnetic body, a dielectric body having a low permittivity, and a magnetic body having a low magnetic permeability, are overlapped on a flat reflector plate, and where the relationship between the magnetic permeability $\mu 1$ of said sintered ferrite magnetic body and the magnetic permeability of said magnetic body having a low magnetic permeability is $\mu 1 \geqq 25 \cdot \mu 2$.

Electromagnetic waves from an electromagnetic wave generation source are transmitted in the direction of a reflector plate, and pass through the magnetic body RF having a low magnetic permeability, and the dielectric body D having a low permittivity and the sintered ferrite magnetic body F and are absorbed in this process. The function of electromagnetic wave absorption is such that at for the low frequencies close to f1, there is practically no influence of the dielectric body D having a low permittivity, and the sintered ferrite having a high magnetic permeability operates independently. On the other hand, for frequencies close to fh, the sintered ferrite, the magnetic body RF having a low magnetic permeability, and the dielectric body D having a low permittivity all function to absorb electromagnetic waves. Accordingly, electromagnetic wave absorption is performed for across a broad band from the low frequency f1 to the high frequency fh.

As has been described above, the present invention is configured from successive layers of an sintered ferrite magnetic body, a dielectric body having a low permittivity, and a magnetic body having a low magnetic permeability, on a metallic reflector plate and so it is possible to easily provided an electromagnetic wave absorption apparatus having a simple structure and which can obtain a broadband characteristic. Then, improving an existing electromagnetic wave absorption apparatus using sintered ferrite, by adding an element having magnetic body having a low magnetic permeability of ferrite and the dielectric body having a low permittivity, enables the configuration of the present invention to be easily attained.

DESCRIPTION OF THE PREFERRED EMBODIMENTS

Figure 1:
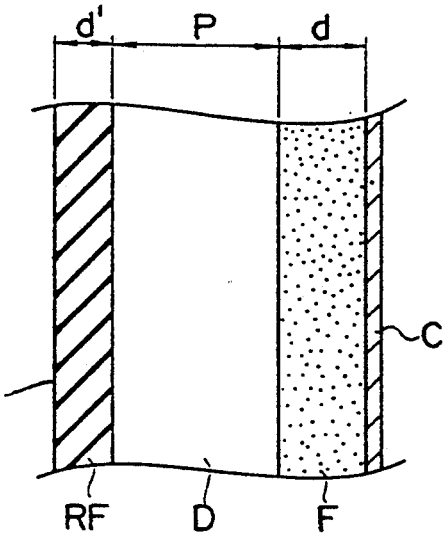
FIG. 1 is a view showing a sectional structure of a first embodiment of the present invention.

FIG. 1 is a view showing a sectional structure of a first embodiment of the present invention. In this embodiment, a sintered ferrite body F having a thickness d is arranged on one side of a metallic reflector plate C, that is, the side from which electromagnetic waves arrive, and then a dielectric body D having a low permittivity is successively placed, followed by a magnetic body RF having a low magnetic permeability having a thickness d'. The dielectric body D having a low permittivity can be a cavity, and if so, can be effectively configured in the same manner as an air cavity by using a material such as polyurethane foam or the like. The magnetic body RF having a low magnetic permeability uses a material such as rubber ferrite. The sintered ferrite F uses a material of the NiZn system and having a magnetic permeability of 2500, and the rubber ferrite RF uses a material such as an MnZn system material mixed as a powder into a rubber base material and so that there is a magnetic permeability of 10.5. However, the configuration of this material has latitude for variation.

In this embodiment, the sintered ferrite having a high magnetic permeability functions to absorb electromagnetic waves at low frequencies close to f1. Also, the dielectric body D having a low permittivity and the magnetic body RF having a low magnetic permeability function together to absorb electromagnetic waves having high frequencies close to fh.

Figure 2:
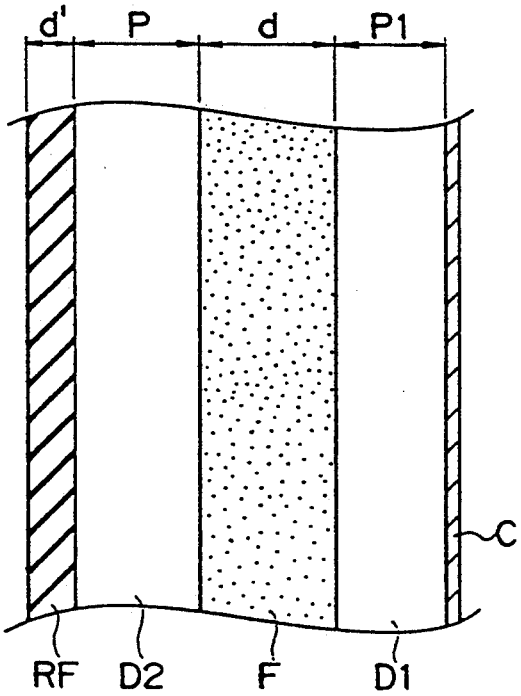
FIG. 2 is a view showing a sectional structure of a second embodiment of the present invention.
Figure 9:
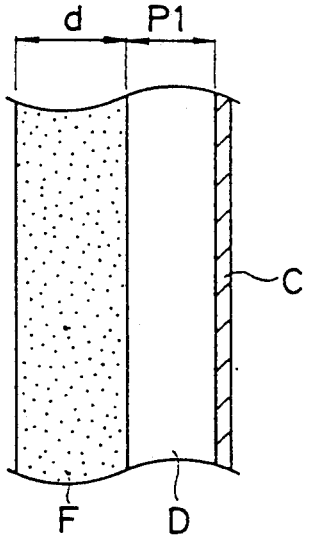
FIG. 9 PRIOR ART
FIG. 9 is a view showing another conventional example of the structure for broadening the band of the apparatus shown in FIG. 1.

FIG. 2 is a view showing a sectional structure of a second embodiment of the present invention and is an improvement of the conventional apparatus shown in FIG. 9, with the two layers of a second dielectric body D2 having a low permittivity and a thickness p, and a magnetic body RF having a low magnetic permeability and a thickness d' being added in the direction of arrival of electromagnetic waves in the example of the configuration shown in FIG. 9. The existing dielectric body having a low permittivity and which is adjacent to the metallic reflector plate C is termed the first dielectric body having a low permittivity.

Figure 3:
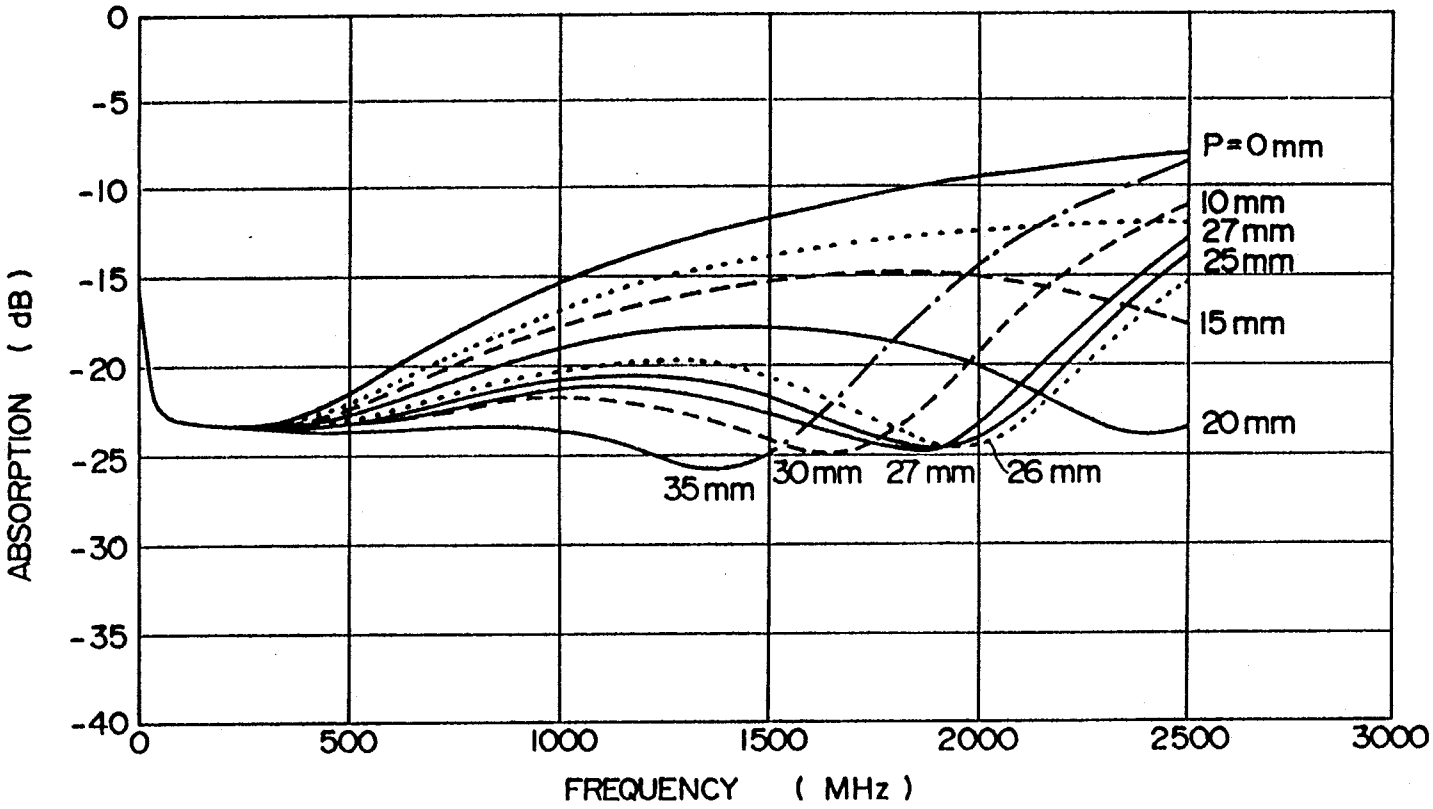
FIG. 3 is a view showing the electromagnetic wave absorption characteristics of the first embodiment shown in FIG. 1.

FIG. 3 is a view showing the electromagnetic wave absorption characteristics of the first embodiment shown in FIG. 1 and shows the characteristics for when the thickness of the sintered ferrite F is 6.6 mm, when the thickness p of the dielectric body D having a low permittivity is 0–35 mm, and when the thickness d of the magnetic body RF having a low magnetic permeability is 1.0 mm. Then, actual measurements were made for the frequency-reflectivity absorption characteristics as absorption characteristics for each of the cases where the actual thickness p of the dielectric body D having a low permittivity was 0, 10, 15, 20, 25, 26, 27, 30 and 35 mm.

From these characteristics, a constant absorption of about 23 dB was obtained for low frequencies, that is a low range of frequencies of 30–300 MHz but in the frequency region higher than this, the absorption characteristic differed in accordance with the thickness p of the dielectric body D having a low permittivity. More specifically, when the thickness p of the dielectric body D having a low permittivity was zero, the degree of absorption deteriorated with increasing frequency and there was absorption of about 7 dB at a frequency of 2500 MHz. For p=10 mm, there was 12 dB at 2500 MHz, and the degree of absorption deteriorated accompanying frequencies increasing up to this but when the thickness p was large at 15 mm, the characteristics curve showed a recovery of the absorption characteristic at a midway frequency with the degree of absorption increasing.

Assuming a frequency range of 30–1000 MHz, the degree of absorption is better for the high-frequency portions for the larger the thickness d, and for example, a substantially flat electromagnetic wave absorption characteristic was obtained for p=35 mm. However, for up to the high frequency region, there was a maximum absorption in the vicinity of 1400 MHz for p=35 mm, with the degree of absorption deteriorating thereafter. Then, for a degree of absorption of −20 dB or less, the broadest band was obtained for a thickness of p=25 mm, and the high frequency limit fh was 2300 MHz.

Figure 4:
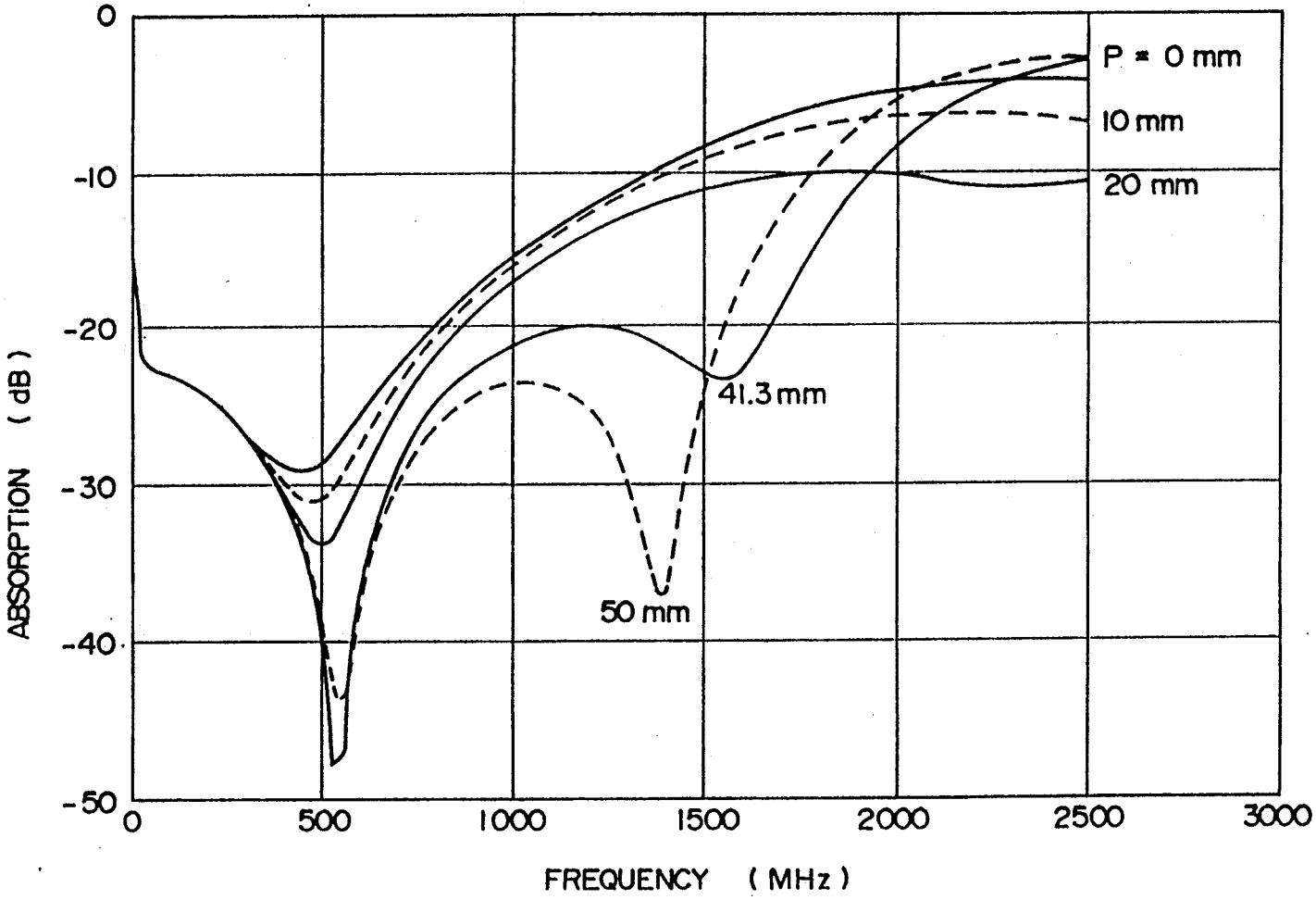
FIG. 4 is a view showing the electromagnetic wave absorption characteristics of the second embodiment shown in FIG. 2.

FIG. 4 is a view showing the electromagnetic wave absorption characteristics of the second embodiment shown in FIG. 2, and shows values actually measured for changing the thickness p of the second dielectric body D2 having a low permittivity for when the thickness of the first dielectric body D1 having a low permittivity was p1 =8.5 mm, when the thickness d of the sintered ferrite F was 6.6 mm, and when the thickness d' of the magnetic body RF having a low magnetic permeability was 1.3 mm. When the characteristics were measured for each case of the thickness p being 0, 10, 20, 41.3 and 50 mm, a high-frequency limit fh=1700 MHz was obtained for p=41.3 mm.

Figure 5:
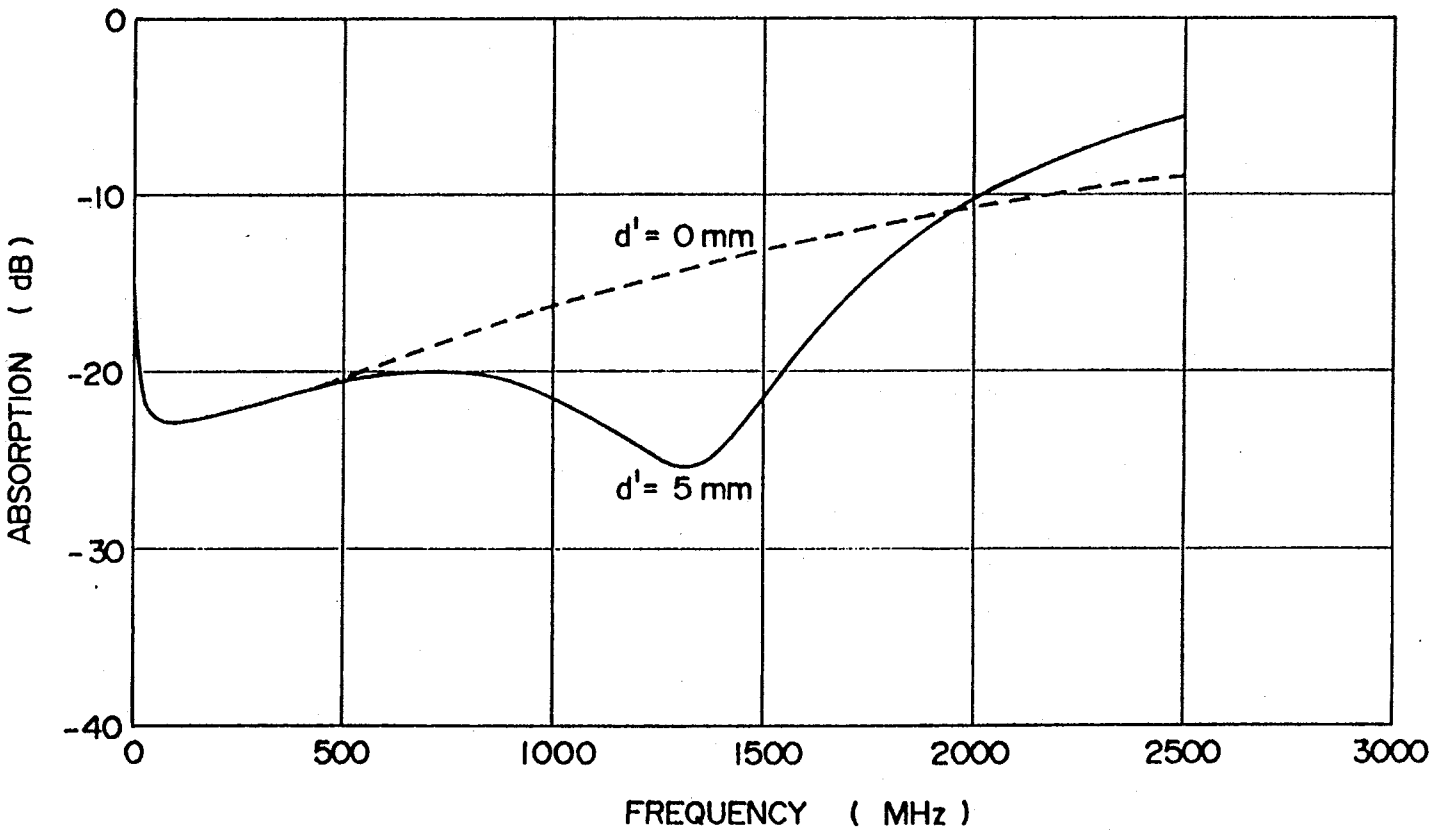
FIG. 5 is a view showing the electromagnetic wave absorption characteristics of a modified embodiment based on the first embodiment.
Figure 6:
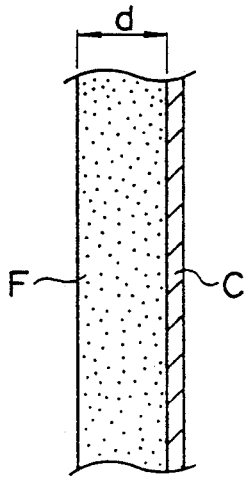
FIG. 6 PRIOR ART
FIG. 6 is a view showing a sectional structure of a conventional electromagnetic wave absorption apparatus.
Figure 7:
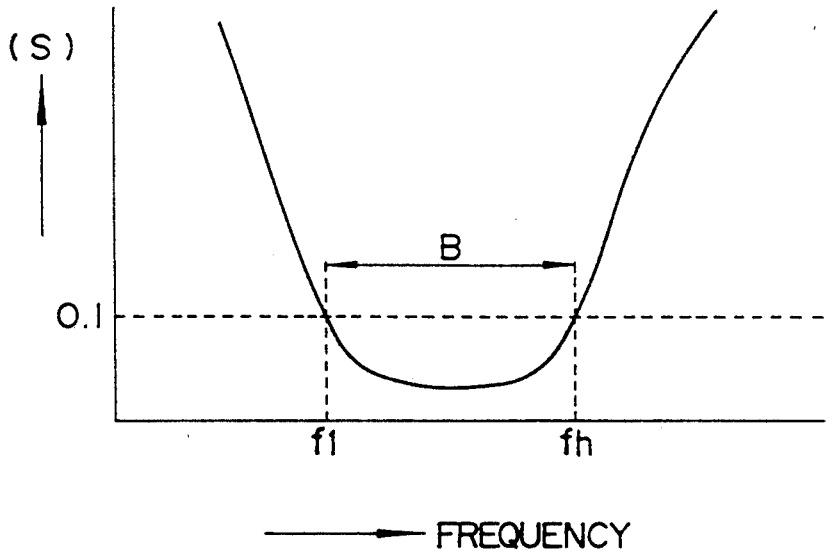
FIG. 7 PRIOR ART
FIG. 7 is a view showing the electromagnetic wave the absorption characteristic of fundamental absorber shown in FIG. 6.
Figure 8:
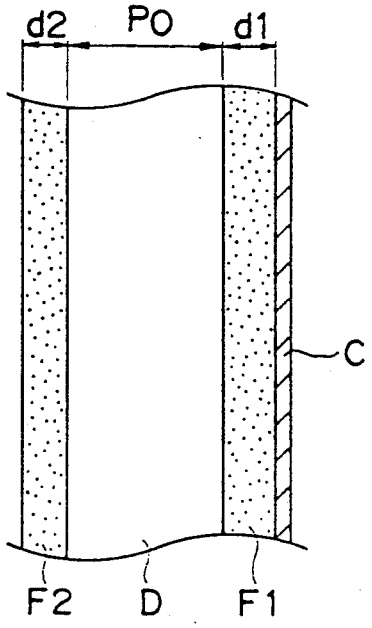
FIG. 8 PRIOR ART
FIG. 8 is a view showing a conventional example of the structure for broadening the band of the apparatus shown in FIG. 1.

FIG. 5 is a view showing the electromagnetic wave absorption characteristics of a modified embodiment based on the first embodiment and shows the measurements for when a dielectric body D3 was used instead of the rubber ferrite RF in the embodiment shown in FIG. 1. The characteristics indicated by the solid line relate to when the sintered ferrite F had a thickness of d=6.6 mm, when the dielectric body D had a thickness p=40.5 mm and when the dielectric body D3 had a thickness d' of 5 mm. When this is compared to the case shown by the broken line for when there was a thickness of d'=0 mm, the characteristics have the improved range of 500–1900 MHz and the range of frequencies for which there is an absorption of 20 dB is extended to 1500 MHz. From this, it can be safely assumed that it is possible for the embodiment shown in FIG. 2 to be configured using a dielectric body instead of rubber ferrite. This is actually possible. (Other embodiments)

The apparatus of the present invention can also be configured by using an adhesive agent or a reinforcing agent to provide an extremely thin layer of material having a low magnetic permeability and a low permittivity between the elements of each of the layers. In addition, it is also possible to paint the wall or to provide a fascia material or the like to improve the external appearance.

If a lossy dielectric material is additionally provided in front of the apparatus of the present invention, the high-frequency limit fh can be higher so that a broader band apparatus be achieved.

What is claimed is:

1. A broadband electromagnetic wave absorbing apparatus comprising:

successive layers of a first dielectric body, a sintered ferrite magnetic body, a second dielectric body having a low permittivity, and a magnetic body having a low magnetic permeability overlapped on a flat reflector plate, said first dielectric being disposed between said reflector plate and said sintered ferrite magnetic body, and where the relationship between the magnetic permeability $\mu 1$ of said sintered ferrite magnetic body and the magnetic permeability of $\mu 2$ of said magnetic body having a low magnetic permeability is $\mu 1 \geqq 25 \cdot \mu 2$.

2. The broadband electromagnetic wave absorbing apparatus of claim 1, wherein:

said second dielectric body has a permittivity smaller than 70.

* * * * *